US005975675A

United States Patent [19]

Kim

[11] Patent Number: 5,975,675

[45] Date of Patent: Nov. 2, 1999

[54] PERFUME SPRAYING PRINTER

[75] Inventor: Yong-Geun Kim, Suwon, Rep. of Korea

[73] Assignee: SamSung Electronics Co., Ltd., Kyungki-do, Japan

[21] Appl. No.: 08/855,599

[22] Filed: May 13, 1997

[30] Foreign Application Priority Data

May 13, 1996 [KR] Rep. of Korea ..... 96-15790

[51] Int. Cl.[6] ..... B41J 2/015

[52] U.S. Cl. ..... 347/20

[58] Field of Search ..... 347/20, 85, 86, 347/87

[56] References Cited

U.S. PATENT DOCUMENTS

| | | | |
|---|---|---|---|
| 3,888,689 | 6/1975 | Maekawa et al. | 106/24 |
| 5,018,974 | 5/1991 | Carnahan et al. | 434/98 |
| 5,093,182 | 3/1992 | Ross | 428/195 |
| 5,477,249 | 12/1995 | Hotomi | 347/48 |
| 5,515,085 | 5/1996 | Hotomi et al. | 347/54 |
| 5,577,947 | 11/1996 | Malloy et al. | 446/220 |
| 5,828,389 | 10/1998 | Yamaguchi et al. | 347/23 |

FOREIGN PATENT DOCUMENTS

| | | |
|---|---|---|
| 59-12977 | 1/1984 | Japan . |
| 59-145263 | 8/1984 | Japan . |

*Primary Examiner*—N. Le
*Assistant Examiner*—Michael Nghiem
*Attorney, Agent, or Firm*—Robert E. Bushnell, Esq.

[57] ABSTRACT

There is disclosed a perfume spraying printer including a head assembly sliding on a rail mounted inside the printer; and multiple perfume assemblies attached to one side of the head assembly that contain various kinds of perfumes; wherein a user-selected combination of perfumes can be sprayed onto a sheet of printing papers as the head assembly is moved left and right to form characters on the printing papers.

10 Claims, 6 Drawing Sheets

PERFUME SPRAYING PRINTER

CLAIM OF PRIORITY

This application makes reference to, incorporates the same herein, and claims all benefits accruing under 35 U.S.C. §119 arising from an application for a Perfume Spraying Printer earlier filed in the Korean Industrial Property Office on May 13, 1996 and there duly assigned Ser. No. 15790/1996.

FIELD OF THE INVENTION

The present invention relates to a printing apparatus. More specifically, it relates to a perfume spraying printer which can selectively spray various perfumes on print media.

DESCRIPTION OF THE RELATED ART

Current printing tecdmologies include: laser printers using low power lasers, and LED printers using light emitting diodes to produce image-forming charges; ink jet printers, using deflection of ink particles sprayed from nozzles; thermal-transfer printers, printing colors of color films on print media by heat; and others. All of these printers are designed to print characters and other visual images on a print media such as printing papers. Since use of printers in homes as well as offices is increasing, manufacturers have been developing inexpensive printers with various functions to meet the demand of buyers. Thus, remarkable progress has been made in the manufacture of printers, changing main stream production from mono-font printers to multi-fonts printers, from monochromatic printers to color printers, from low-resolution printers to high-resolution printers. In line with this trend, users may want printers perfuming print media.

U.S. Pat. No. 3,888,689 for an Aqueous Printing Ink Containing Perfume-Containing Microcapsules to Maekawa et al. discloses the use pa perfume containing microcapsules mixed in with an aqueous printing ink. The perfume containing capsules used in this invention have a size of 20 to 80 microns. After printing, the microcapsules are fixedly disposed on the printed matter and when a slight local pressure is applied onto the printed matter by, for instance, rubbing the surface thereof with a nail, the microcapsules at the pressed area are ruptured to release the perfume from the capsules to exhibit in immediate fragrant property. The microcapsules are prepared by a gelatin coacervation process and have the property of being attached to paper to some extent without a binder.

Mixing of ink with perfume is also disclosed in U.S. Pat. No. 5,477,249 for an Apparatus and Methodfor Forming Images by Jetting Recording Liquid onto an Image Carrier by Applying both Vibrational Energy and Electrostatic Energy to Hotomi and U.S. Pat. No. 5,515,085 for an Ink-Jet Type Recorder to Hotomi et al. In each of these patents, the addition of perfume can be added to the pigment dispersion of ink. Thus, the dispersion of the pigment is improved by the addition of perfume.

U.S. Pat. No. 5,577,947 for Scented Ink and Method of Use on Novelty Items to Malloy et al. discloses mixing ink with fragrance oils to produce scented ink. By adding the proper concentration of fragrant oil, the chemical properties in printing characteristics of the ink are maintained. In addition, the choice of scent for a given image is limited only by the imagination of the designer. The scented ink composition can be applied to balloons using conventional printed methods currently used in the art by substituting scented ink for conventional printing ink. The scented ink is comprised of a mixture of conventional printing ink, well known and widely used in the art, with any number of widely available concentrated fragrant oil. The selected fragrant oil of the desired scent is added to the printing ink at a composition of at least 4% by weight but no more than 7% by weight.

U.S. Pat. No. 5,018,974 for a Coloring Book or the Like with Ink Reactive, Fragrance-Releasing Areas to Carnahan et al. discloses the use of microcapsules that contain fragrant oil for particular fragrance associated with the image area deposited on the image area of a substrate. A color dispenser such as a felt tip marking pen is adapted to include a reactive agent that when applied to the image area in the normal course of coloring will cause release of the fragrance by rupturing or otherwise interacting with the microcapsules such as by diffusing into the microcapsules and replacing and releasing the oil.

U.S. Pat. No. 5,093,182 for a Sustained-Release, Print-Compatible Coatings for Fragrance Samplers to Ross disclose perfume containing coatings is used in advertising samplers having printed thereon an ink image and a sustained release perfume containing composition that is compatible with the print ink image.

Japanese patents JP-59/12977 to Miyakawa and JP-59/145263 to Miura et al. each disclose and claim recording ink mixed with an aromatic compound for jet-ink printing devices.

I have noticed that each of these references combines or mixes the perfume with the ink in the production of a printed image. What is needed is an apparatus that applies the perfume in locations separate and apart from where the ink is deposited. In this fashion, the perfume can still scent the printed page but need not mix with the ink. Such a procedure and apparatus would allow for the scenting of print media printed using laser printers, LED printers, and any technology that prints images on print media. In addition, I have not seen an apparatus that allows the user to control the quantity or type of perfume used in a printing operation.

SUMMARY OF THE INVENTION

It is an objective to provide a perfume spraying printer which can apply perfume to print media at a location on the print media separate from where the printed characters are printed.

It is another objective to provide a perfume spraying printer which can satisfy users by spraying a user-desired amount of perfume on print media during printing.

It is yet another objective to provide a perfume spraying printer which can satisfy users by spraying a different types of perfume, each having a different fragrance.

In order to realize the above objectives, the present invention involves a perfume spraying printer including a head assembly which slides on a rail mounted inside the printer, and multiple perfume assemblies attached to one side of the head assembly containing various perfumes. A user selected one of the perfume assemblies sprays perfume on a sheet of printing papers while the head assembly is moved by a belt during the printing process.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
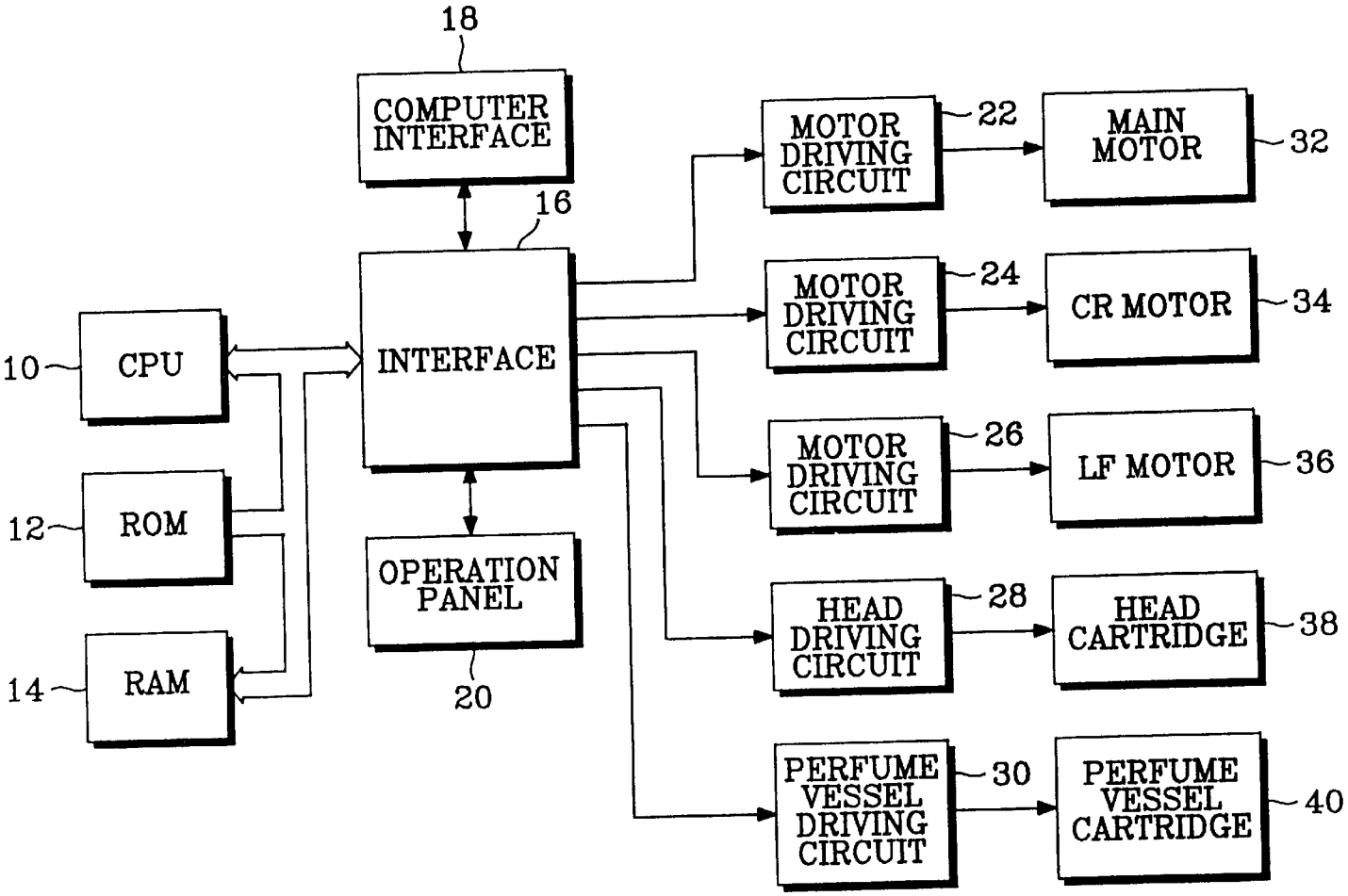
FIG. 1 is a block diagram of a perfume spraying printer in accordance with a first preferred embodiment of the present invention.

FIG. 1 is a block diagram of a perfume spraying printer in accordance with a first embodiment of the present invention where a perfume vessel driving circuit 30 and a perfume vessel cartridge 40 are added to a conventional ink jet printer. A central processing unit (CPU) 10 controls the overall operation of the printer according to a program stored in a read only memory (ROM) 12. ROM 12 stores the operating program for CPU 10 and initial data. A random access memory (RAM) 14 temporarily stores data produced through the operation of CPU 10. An interface 16 links CPU 10 to components of the printer. A computer interface 18 provides a parallel type interface for receiving data from a host computer (not shown). An operation panel 20 includes a set of keys by which control commands are fed into the printer, and a display that displays status information during the printing operation. Motor driving circuit 22 drives a main motor 32 under the control of CPU 10. Motor driving circuit 24 drives a carriage convey motor (hereinafter, referred to as CR motor) 34 under the control of CPU 10. Carriage convey motor 34, driven by motor driving circuit 24, moves a head cartridge 38 in a horizontal direction. A motor driving circuit 26 is controlled by CPU 10 to drive a line feed (LF) motor 36. Line feed motor 36, responding to motor driving circuit 26, conveys printing papers. A head driving circuit 28 drives a head cartridge 38 under the control of CPU 10. Head cartridge 38 responds to signals from head driving circuit 28 to spray ink particles onto the printing papers. Perfume vessel driving circuit 30 controls perfume vessel cartridge 40, under the direction of CPU 10. Perfume vessel cartridge 40, driven by perfume vessel driving circuit 30, sprays perfume onto the printing papers.

Figure 2:
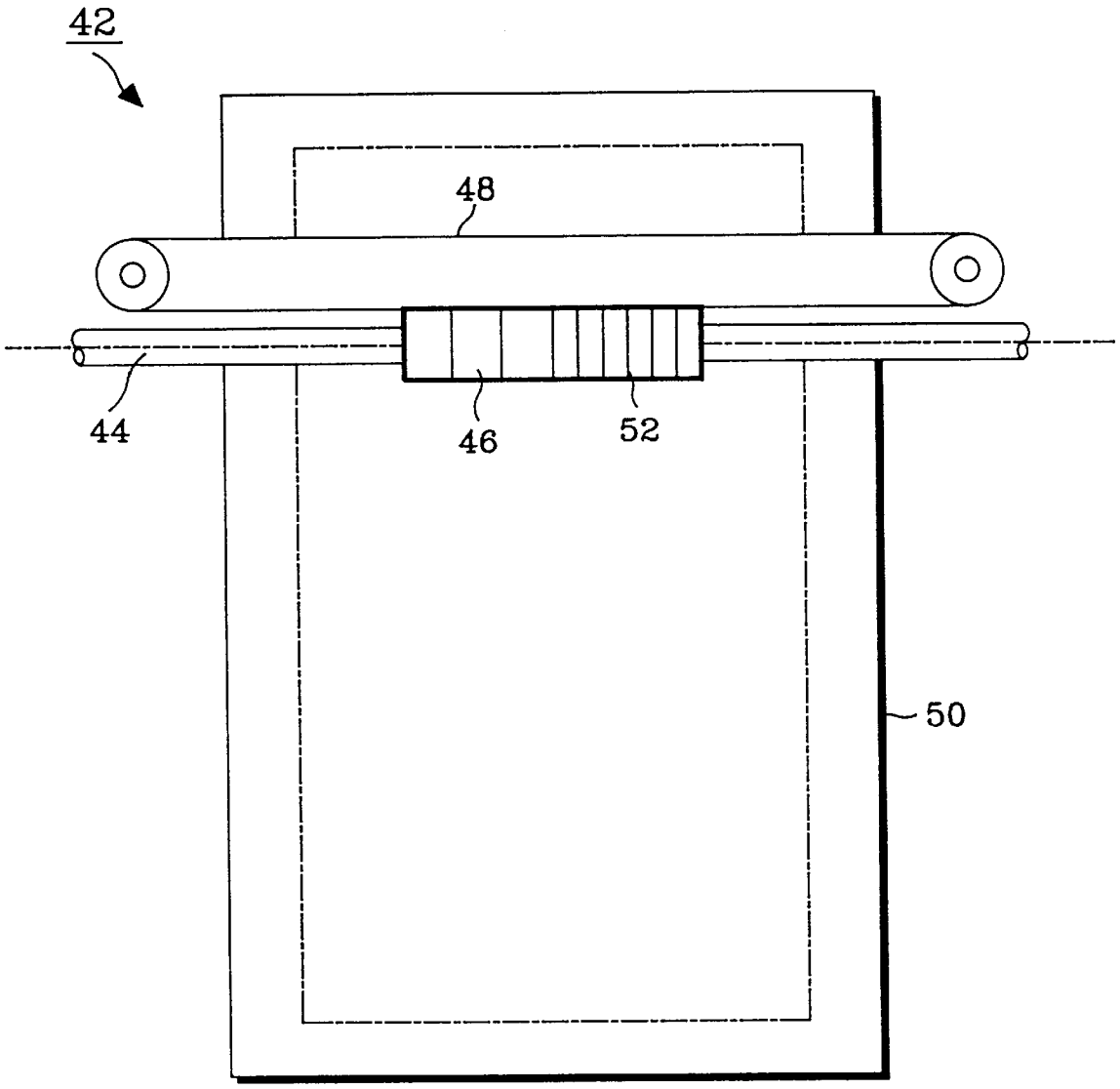
FIG. 2 shows a perfume spraying mechanism for a printer in accordance with a first preferred embodiment of the present invention.

FIG. 2 shows a perfume spraying mechanism of a printer in accordance with the first embodiment of the present invention. In a perfume spraying printer 42, multiple perfume assemblies 52, containing various perfumes, are attached to one side of a head assembly 46, and head assembly 46 is moved left and right by belt 48, allowing perfume assemblies 52 to apply perfume to printing papers 50. Head cartridge 38 is installed on head assembly 46, and perfume vessel cartridge 40 is installed on perfume assemblies 52. Belt 48 is moved with a pulley attached to carriage convey motor 34. Head assembly 46 sprays ink particles on printing papers 50's surface so that characters are printed out, and at least one of perfume assemblies 52 sprays perfume on printing papers 50's non-print region so that the perfume sinks into the printing papers. Additionally, perfume assemblies 52 selectively spray various kinds of perfumes on printing papers 50 using a piezo or thermal effect in response to a user's input.

As printing papers 50 is fed into printer 42, head assembly 46 and perfume assemblies 52 are moved left and right together, thus being ready to operate. Head assembly 46 sprays ink particles to form characters on printing papers 50 upon receipt of a signal to print from a host computer (not shown), and a perfume assemblies 52, installed on one side of head assembly 46, scatters perfume on printing papers 50's non-print region in response to a user keyed input.

Figure 3:
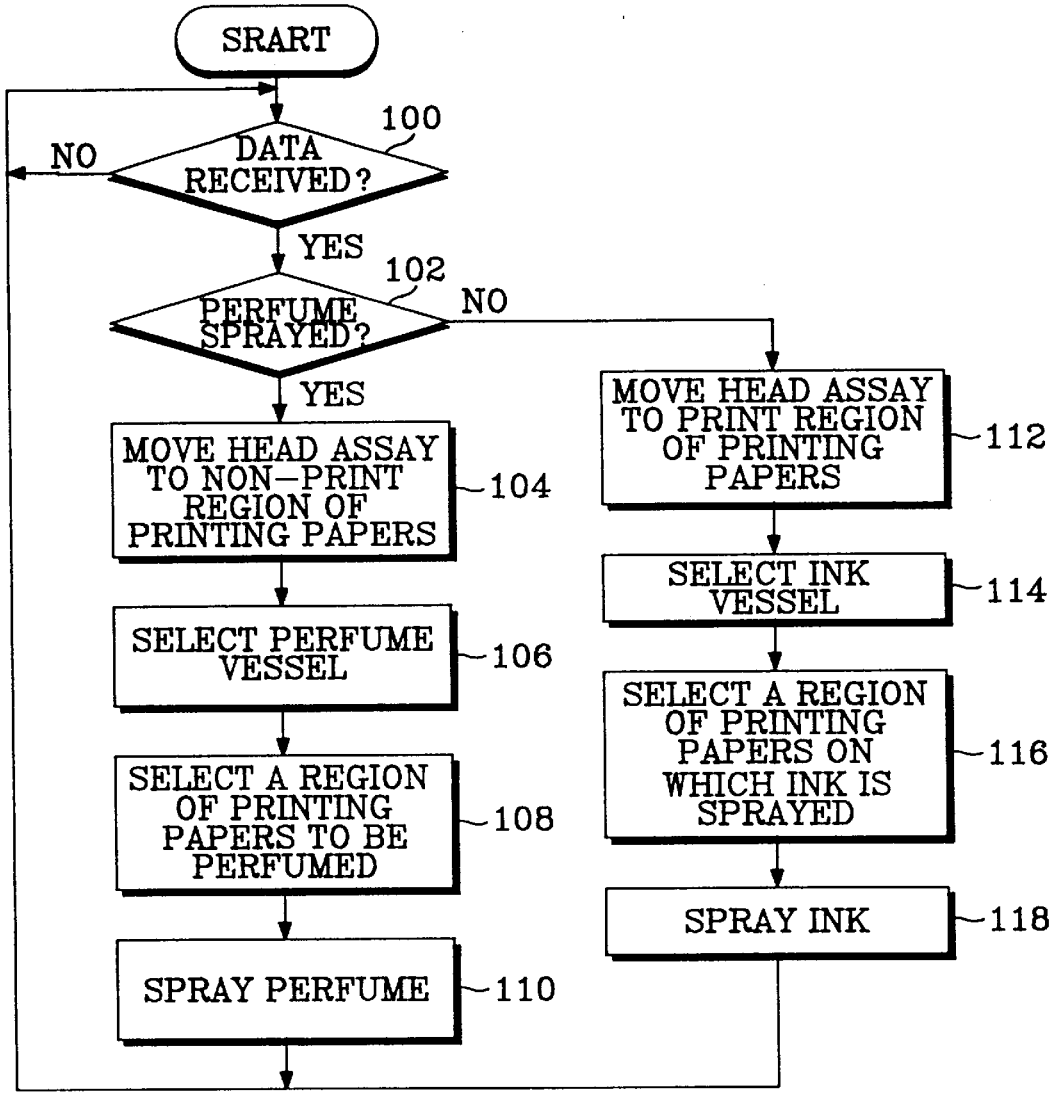
FIG. 3 is a flowchart of the control sequence for a printer in accordance with a first preferred embodiment of the present invention.

CPU 10 carries out the control sequence as described in FIG. 3. Once CPU 10 receives data from the host computer (not shown), it responds (S100) to it and determines (S102) if perfume is to be applied or not. When CPU 10 determines (S102) that perfume is to be applied, it moves (S104) head assembly 46 to printing papers 50's non-print region. CPU 10 allows a user-selected perfume to be applied to printing papers 50's region to be perfumed (S106 to S110). The perfume vessels and region to be perfumed are selected by a user with a keyboard input. When the printing operation is to be carried out, CPU 10 moves (S112) head assembly 46 to printing papers 50's print region where characters are to be formed, and allows a user-selected ink to be sprayed on a user-selected region of printing papers 50. Head assembly 46 sprays ink particles to form characters or graphics on printing papers 50, and a user-selected one of perfume assemblies 52 scatters perfume on printing papers 50's non-print region so that printing papers 50, where characters are formed, emits fragrance.

A user may select the amount of perfume to be scattered on printing papers 50, the amounts of two or more different perfumes to be scattered at the same time, the portion of printing papers where perfume will be scattered, and the time when perfume will be scattered on printing papers with corresponding menus from the computer or printer. Perfume assemblies 52 selectively spray perfume on printing papers 50 according to user-selected conditions. In this way, the perfume spraying printer sprays a user-desired amount of perfume onto the print media during printing.

Figure 4:
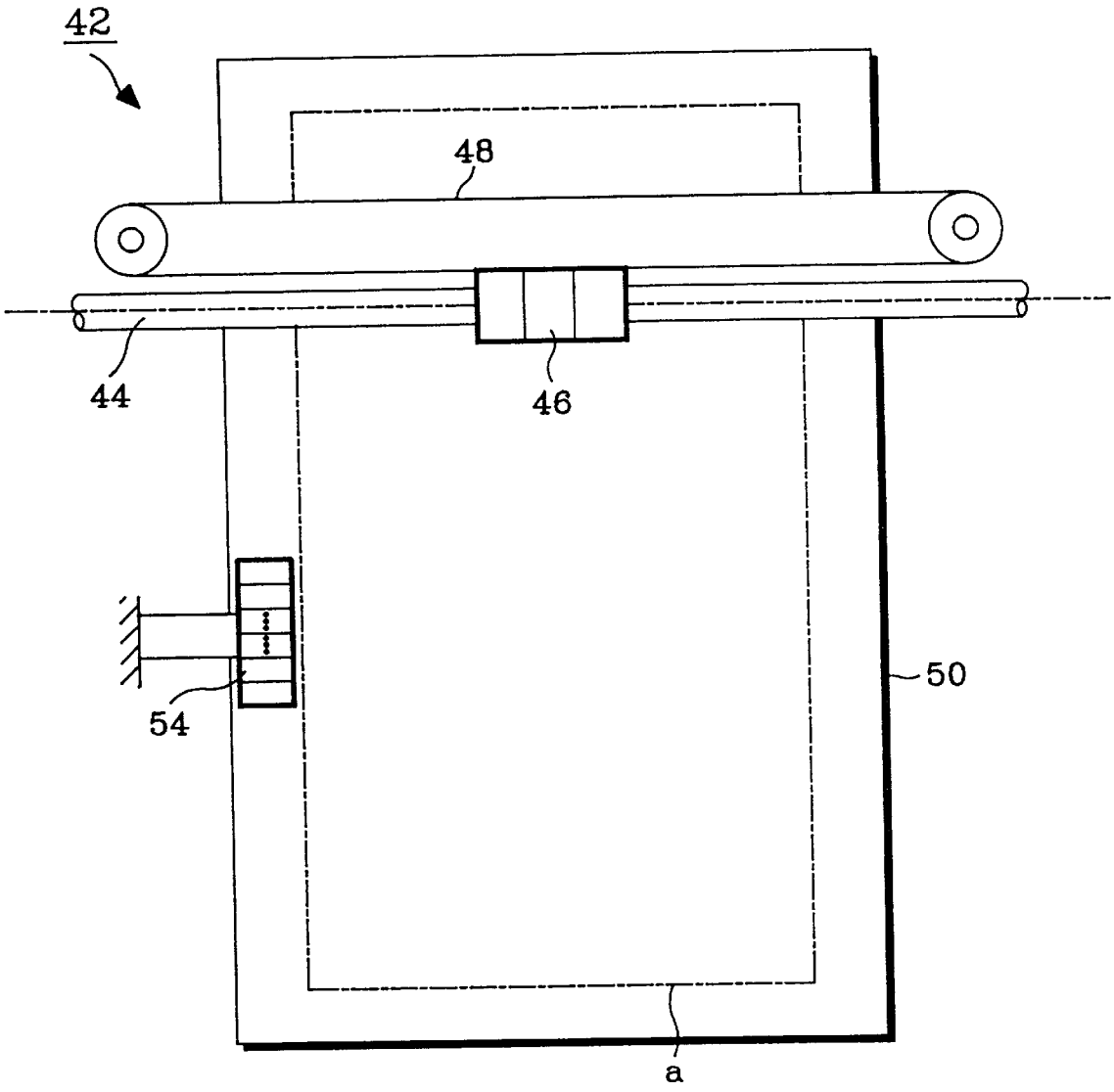
FIG. 4 shows a perfume spraying mechanism of a printer in accordance with a second preferred embodiment of the present invention.

FIG. 4 shows a perfume spraying mechanism for a printer in accordance with a second embodiment of the present invention. In a perfume spraying printer 42, a head assembly 46 slides on a rail 44 mounted inside the printer, and is moved left and right by a belt 48 to form characters on sheets of printing papers 50. Perfume assemblies 54 are installed in printer 42 so as to selectively spray various perfumes on non-print regions of printing papers 50 outside the margins of print region (a). Perfume assemblies 54 selectively spray various kinds of perfumes on printing papers 50 using a piezo or thermal effect in response to a user keyed input.

As printing papers 50 are fed into printer 42, head assembly 46, connected to belt 48 and sliding on rail 44, is moved left and right so as to form characters within the print region (a) of printing papers 50. Perfume assemblies 54, located over the non-print region of printing papers 50, scatter perfume on printing papers 50.

Figure 5:
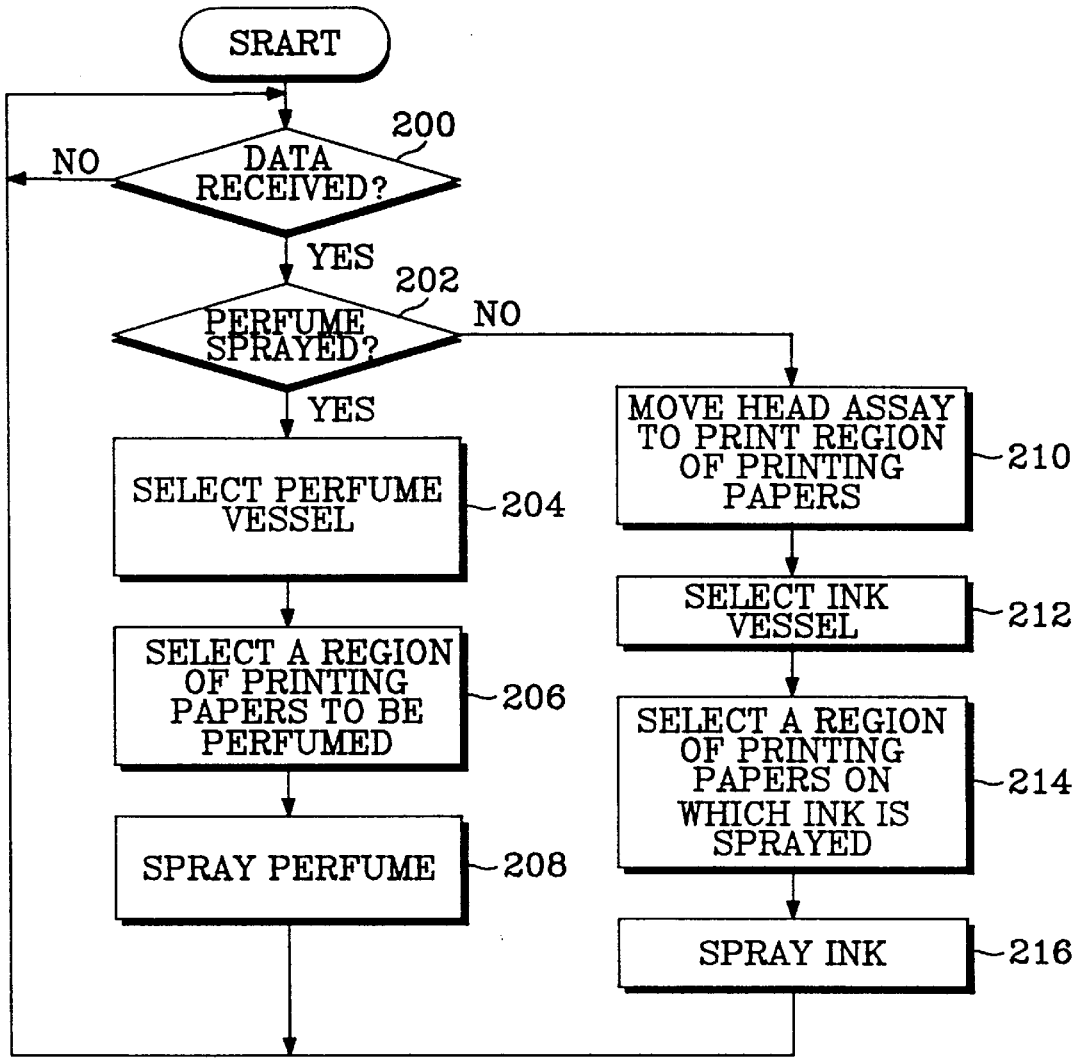
FIG. 5 is a flowchart of the control sequence of the printer in accordance with a second preferred embodiment of the present invention.

CPU 10 performs the control sequence as depicted in FIG. 5. Once CPU 10 receives data from the host computer (not shown), it responds (S200) to it, determining whether (S202) perfume is to be applied or not. When CPU 10 determines (S202) that perfume is to be applied, it allows a user-selected perfume to be sprayed on printing papers 50's region to be perfumed (S204 to S208). When the printing operation is to be carried out, CPU 10 moves (S216) head assembly 46 to printing papers 50's print region (a) within the print margins, where characters are to be formed, and allows a user-selected ink to be sprayed on user-selected portions of printing papers 50. In this manner, head assembly 46 sprays ink particles to form characters or graphics on printing papers 50's print region (a), and perfume assemblies 54, which are outside of the margins of print region (a), selectively scatter perfume on printing papers 50's non-print region so that printing papers 50, where characters are formed, has a fragrance.

Figure 6:
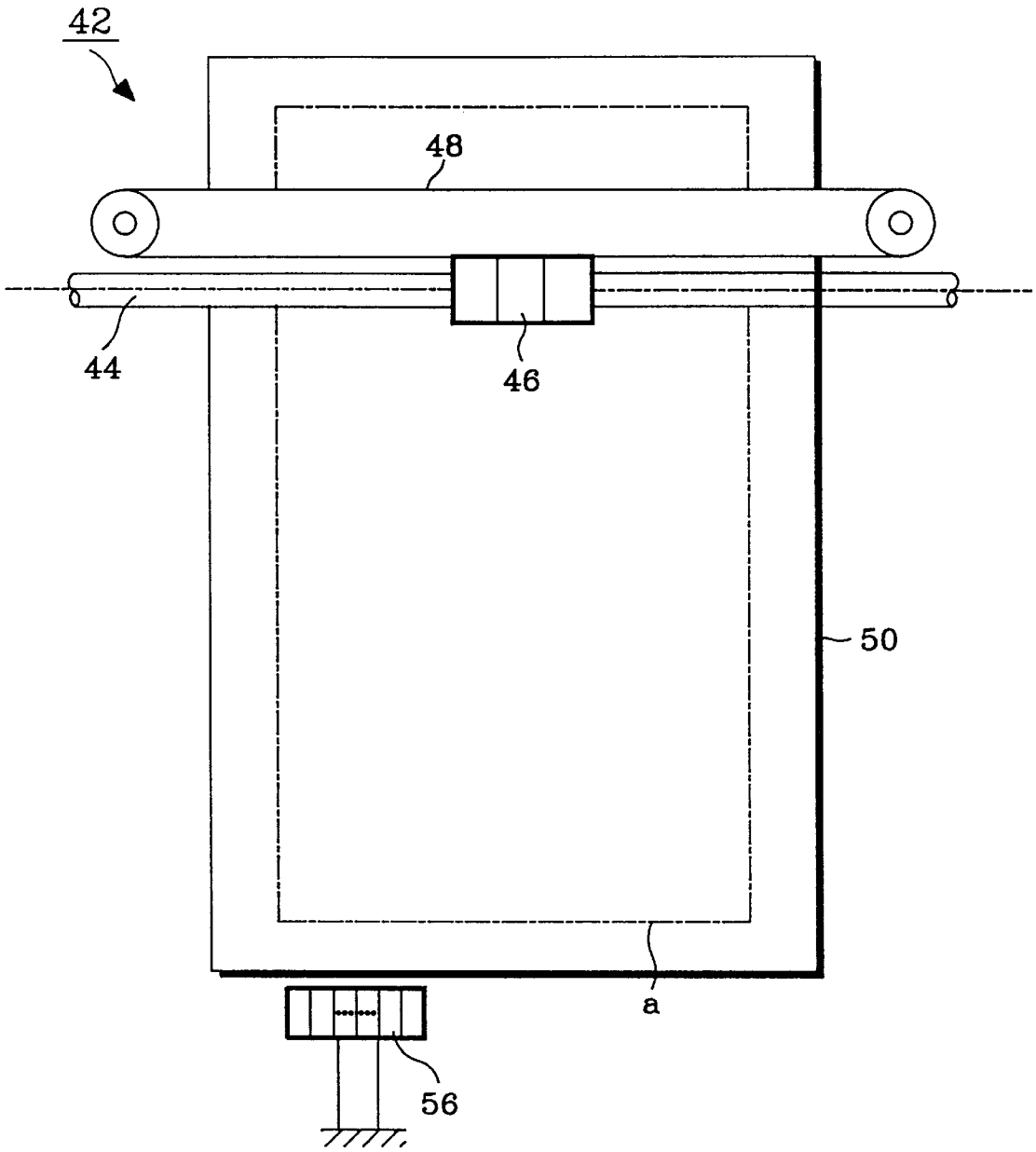
FIG. 6 shows a perfume spraying mechanism of a printer in accordance with a third preferred embodiment of the present invention.

FIG. 6 shows a perfume spraying mechanism of a printer in accordance with a third embodiment of the present invention. In a perfume spraying printer 42, a head assembly 46 is mounted on a rail 44 and moved left or right by a belt 48 to form characters on sheets of printing papers 50. Perfume assemblies 56 are mounted on printer 42, spacing from head assembly 46 that are positioned over a print region (a) of printing papers 50. Perfume assemblies 56 have the same function as described in the first and second embodiments of the present invention.

As printing papers 50 are fed into printer 42, head assembly 46, connected to belt 48 and guided by rail 44, is moved left and right so as to form characters on print region (a) of printing papers 50. Perfume assemblies 56 are mounted over print region (a) of printing papers 50, to apply various perfumes to blank lines where characters are not formed.

CPU 10 performs the control sequence depicted in FIG. 5, which is similar to the first and second embodiments of the present invention. As described above, a user-selected one of perfume assemblies 56 spaced from head assembly 46 sprays perfume between printed lines simultaneously with head assembly 46's forming of characters one line at a time, on print region (a) of printing papers 50.

Therefore, it should be understood that the present invention is not limited to the particular embodiment disclosed herein as the best mode contemplated for carrying out the present invention, rather the present invention is not limited to the specific embodiments described in this specification except as defined in the appended claims.

What is claimed is:

1. A perfume spraying printer comprising:

a rail mounted inside said printer;

a head assembly sliding on said rail mounted inside the printer; and at least one perfume assembly, said at least one perfume assembly attached to the head assembly, each of said at least one perfume assembly containing perfume; said at least one perfume assembly spraying perfume onto sheets of printing papers as said head assembly is moved to print on the printing papers.

2. The perfume spraying printer according to claim 1, wherein said at least one perfume assembly is piezo-electrically controlled for spraying perfume onto unprinted areas of the printing papers according to user keyed input.

3. The perfume spraying printer of claim 2, wherein said unprinted areas are spaces between lines of ink printed material.

4. The perfume spraying printer of claim 2, wherein said unprinted areas are margin areas on a sheet of ink printed material.

5. The perfume spraying printer according to claim 1, said at least one perfume assembly is thermally-pumped controlled for spraying perfume onto unprinted areas of the printing papers according to user keyed input.

6. The perfume spraying printer of claim 5, wherein said unprinted areas are spaces between lines of ink printed material.

7. The perfume spraying printer of claim 5, wherein said unprinted areas are margin areas on a sheet of ink printed material.

8. A perfume spraying printer comprising:

a belt;

a rail within the printer to be moved by said belt;

a head assembly sliding on said rail within the printer to print on sheets of printing papers; and at least one perfume assembly mounted within the printer over a margin areas of the printing papers so as to spray perfume on the margin areas of the printing papers.

9. A perfume spraying printer comprising:

a belt;

a rail within the printer to be moved by said belt;

an ink head assembly sliding on said rail within the printer to print ink on sheets of printing papers; and at least one perfume assembly located in the printer, spaced apart from the head assembly and positioned to selectively spray perfume on the printing papers in a region to be printed on.

10. The perfume spraying printer according to claim 9, wherein said at least one perfume assembly is mounted in the printer so as to selectively spray perfume between regions of said printing papers on which said ink is printed.

* * * * *